United States Patent [19]

Haeussler et al.

[11] 4,398,762

[45] Aug. 16, 1983

[54] PICKUP DEVICE FOR LIFTING CONCRETE BODY

[75] Inventors: Ernst Haeussler, Grashofstr. 47, 4300 Essen-Bredeney, Fed. Rep. of Germany; Ernst Hatz, Darmstadt, Fed. Rep. of Germany; Olle Malmen, Askim, Sweden; Henning Schilla, Essen-Frintrop; Karl E. Schlick, Rüsselsheim, both of Fed. Rep. of Germany

[73] Assignee: Ernst Haeussler, Essen-Bredeney, Fed. Rep. of Germany

[21] Appl. No.: 247,326

[22] Filed: Mar. 25, 1981

[30] Foreign Application Priority Data

Mar. 29, 1980 [DE] Fed. Rep. of Germany ..... 3012278
Mar. 29, 1980 [DE] Fed. Rep. of Germany ..... 3012280

[51] Int. Cl.[3] ..... B66C 1/66; B66C 1/36

[52] U.S. Cl. ..... 294/89; 294/82 R; 294/83 R

[58] Field of Search ..... 296/78 R, 83 R, 84, 296/89, 90, 82 R; 24/232, 241; 52/125, 689, 699, 700

[56] References Cited

U.S. PATENT DOCUMENTS 3,480,319 11/1969 Raschke ..... 294/82 R
4,173,367 11/1979 Haeassler ..... 294/89

FOREIGN PATENT DOCUMENTS 2552387 5/1977 Fed. Rep. of Germany ..... 294/89
2708788 1/1979 Fed. Rep. of Germany .

*Primary Examiner*—James B. Marbert
*Attorney, Agent, or Firm*—Karl F. Ross; Herbert Dubno

[57] ABSTRACT

A body to be picked up is provided with a bolt having a relatively narrow shaft embedded in and projecting from the body and a relatively wide head on the shaft spaced from the body. This body is picked up by a device having a shackle provided with a crosspiece defining a lift eye to which is connected a grab cable and a pivot eye. A pickup member is pivotal on the pivot eye of the shackle about a pivot axis and has a generally radially extending actuation arm and an axially elongated and outwardly open pickup slot lying generally in a plane perpendicular to the axis and having a relatively wide end permitting radial passage of the head into and out of the slot and an angularly opposite relatively narrow end internally sufficiently wide to accommodate the head but externally insufficiently wide to permit radial passage of the head out of the slot. This slot is internally sufficiently wide between the ends to permit the head to pass angularly along the slot between the ends with the shaft extending out of the slot. Thus the member can pivot about the axis with the bolt engaged in the slot. An arcuate locking bolt may be displaceable in an arcuate guide slot in the pickup member to block the wide end of the slot.

4 Claims, 11 Drawing Figures

PICKUP DEVICE FOR LIFTING CONCRETE BODY

FIELD OF THE INVENTION

The present invention relates to a pickup device for lifting a concrete body. More particularly this invention concerns such a device which is adapted to coact with a concrete body from which projects a bolt having a relatively narrow shaft embedded in and projecting from the body and a relatively wide head on the shaft spaced from the body.

BACKGROUND OF THE INVENTION

Such a device, as described in my earlier U.S. Pat. Nos. 3,499,676 and 4,173,367 as well as in German Pat. Nos. 2,708,786, 2,708,787, and 2,708,788, has a shackle on which a pivot member is pivotal about a pickup axis. This pickup member has a generally radially extending actuation arm and an angularly elongated and outwardly open pickup slot lying generally in a plane perpendicular to the axis and having a relatively wide end permitting radial passage of the head of the bolt on the body into and out of the slot and an angularly oppositely relatively narrow end internally sufficiently wide to accommodate the head but externally insufficiently wide to permit radial passage of the head out of the slot. The slot is internally sufficiently wide between the ends to permit the head to pass angularly along the slot between the ends with the shaft extending out of the slot. Thus the actuation member can be fitted over the head of the bolt extending from the body by fitting the bolt into the wide end of the slot, then the member can be pivoted about the pivot axis to capture the head of the bolt in the slot, whereupon the concrete block or the like can be lifted by a crane connected to the shackle. Such an arrangement is relatively useful in the concentration of large prefabricated structures, as it allows the precast concrete body to be picked up in a very simple yet extremely safe manner. The pickup device can relatively easily be connected to and disconnected from the bolt, but has safety features which make it impossible for it to become disconnected from the body when under load.

The shackle of such an element normally is relatively long, having a pair of long sides that extend perpendicular to the pivot axis, and a pair of short sides bridging these long sides. One of the short sides forms the pivot axis and the other short side is the element over which the cable or grab of the lifting device is engaged. The shackle must be long enough to allow the actuation arm to pivot through it between the blocking and unblocking positions.

It is also known to provide such a device with a locking bolt slidable in a normally secantally extending guide in the member. This bolt can move between an inner position blocking the wide end of the slot and an outer freeing position clear of this wide end of the slot. When in the blocking position it makes it impossible for a bolt engaged in the slot to move from it, thereby making dropping of an object carried by the pickup device impossible. In such an arrangement the slot of the pickup member normally only extends over 90° relative to the axis. Thus the pickup member can only pivot through 90° between the position where it is dropped down on the pickup bolt and the position where it is locked to the pickup bolt with same in the narrow end of the slot.

The problem with such devices is that it is still possible occasionally for a picked-up body to be released by the pickup member according to this invention. This normally only occurs during accidental freak situations, or from misuse of the device; nonetheless it can happen. The most common accident is when the chain or hook that normally engages over the upper short side of the shackle becomes hooked over one of the long sides of the shackle or becomes wedged between the shackle and the pickup member so that the entire device is twisted seriously to the side when lifted. This can result in overstressing parts and ruining the pickup device.

OBJECTS OF THE INVENTION

It is therefore an object of the present invention to provide an improved pickup device.

Another object is to provide such a device which is relatively easy to hook onto a concrete body from which projects the bolt having a relatively narrow shaft embedded in and projecting from the body and a relatively wide head on the shaft spaced from the body.

A further object is to provide such an arrangement wherein the pickup device will always be lifted straight up.

SUMMARY OF THE INVENTION

These objects are attained according to the instant invention in a pickup device of the above-described general type, but wherein the shackle is provided with a crosspiece that subdivides it into a lift eye and a pivot eye. The pickup member is pivotal on the pivot eye of the shackle and the loop or hook used to lift the device according to this invention engages in the pickup eye. According to this invention it is therefore certain that when whatever element is engaged through the pickup eye is lifted the entire pickup device will be raised in a straight vertical line. There will be no possibility of the hook or cable loop sliding down and catching between the pickup member and the shackle. In fact the pickup eye can be made relatively small relative to the lift eye to further ensure proper alignment when lifted.

According to further features of this invention the arm has an outer end angularly engageable with the crosspiece, so that the radial distance between this outer end and the axis is greater than the diameter of the pivot eye. Thus during a lift when the shackle will extend vertically upwardly from the pivot axis, normally perpendicular to the upper surface of the body being lifted, the pickup body can only be moved through 90°. In this arrangement the slot, however, has an angular length of approximately 180°, so that it is absolutely impossible for the pickup member to pivot through a sufficient angle to release the body it is picking up.

According to another feature of this invention the actuation arm is somewhat shorter and is formed by a pair of side parts. The pickup member is formed with an arcuate groove generally centered on the axis of the pickup member and receiving an arcuate locking bolt that engages angularly across the wide end of the slot when in an inner blocking position. This locking bolt is displaceable between this inner blocking position and an outer freeing position engaged radially between the sides of the actuation arm.

SPECIFIC DESCRIPTION

Figure 1:
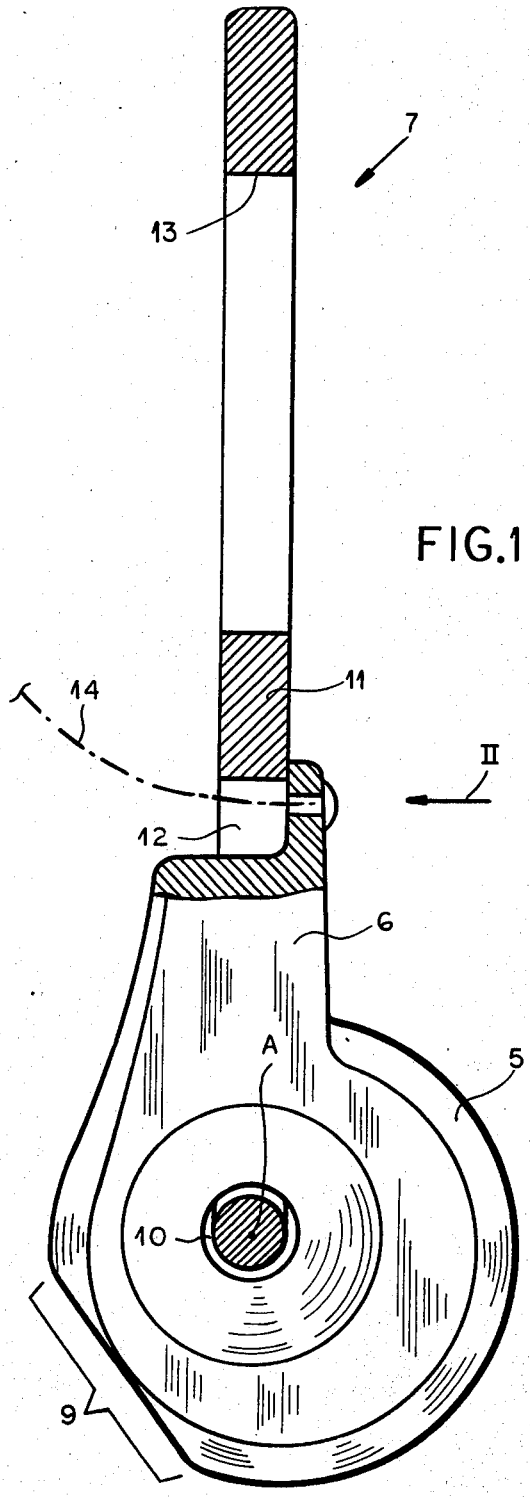
FIG. 1 is a partly sectional side view of a pickup device according to this invention.
Figure 2:
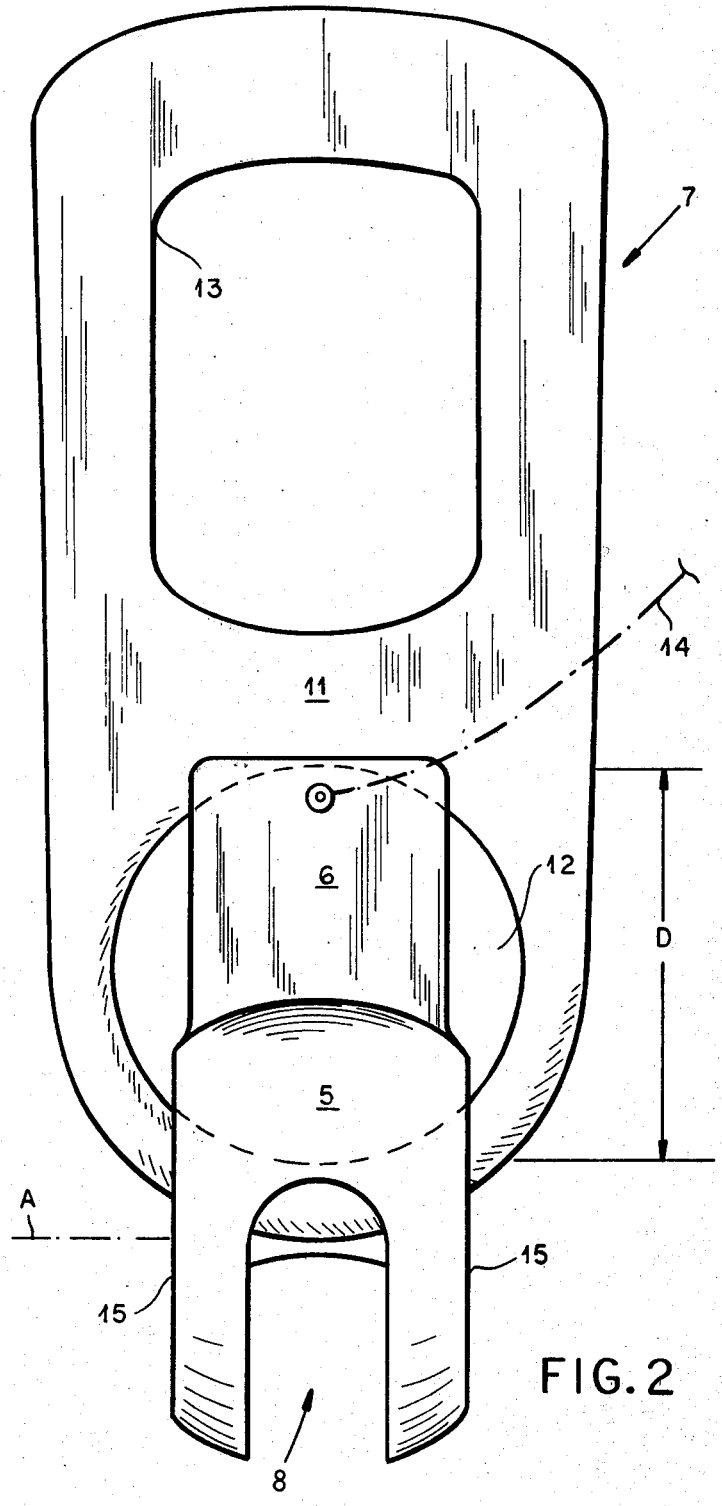
FIG. 2 is a view taken of the direction of arrow II of FIG. 1.
Figure 5:
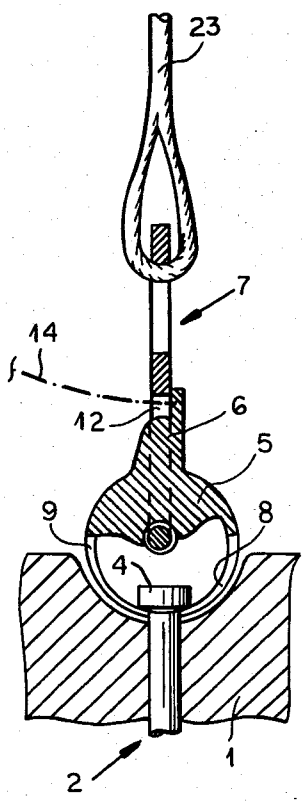
FIGS. 3–5 are vertical sectional views illustrating operation of the arrangement of FIGS. 1 and 2.
Figure 4:
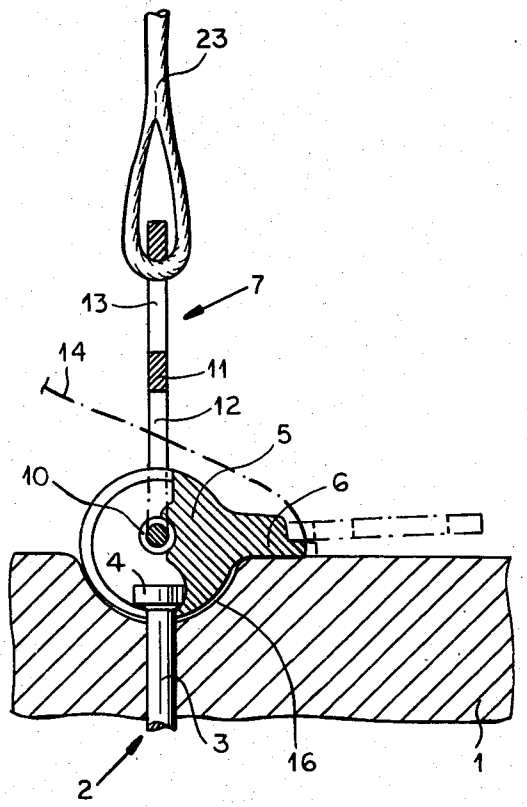
Figure 3:
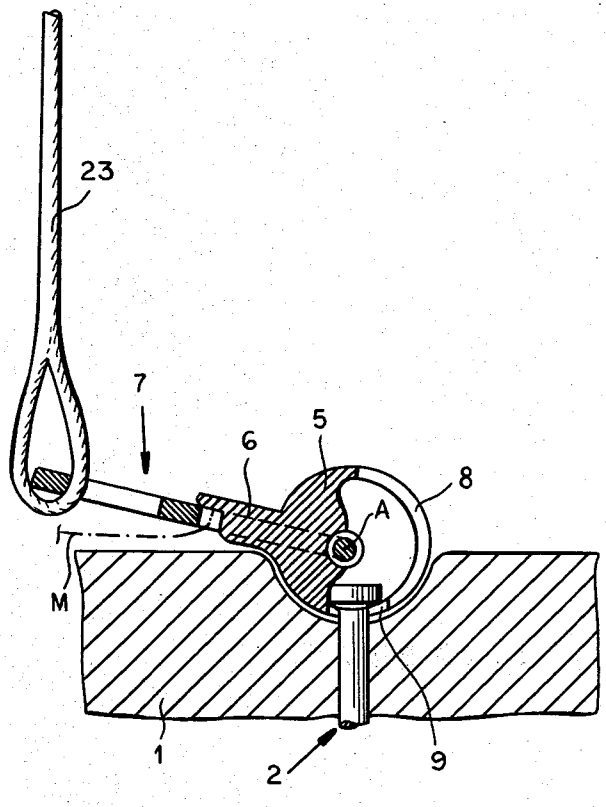

As seen in FIGS. 1–5 a pickup device according to this invention is intended for lifting a concrete body shown at 1 in FIGS. 3–5 and provided with a pickup bolt or anchor bolt 2 having a relatively narrow shaft 3 and a wide head 4. This wide head 4 is exposed in a part-cylindrical recess 16 formed in the upper surface in the concrete block 1.

The pickup device basically comprises a pickup member 5 provided with a radially extending actuation arm 6, and a shackle 7 adapted to be engaged by some sort of lifting element such as the cable loop shown at 23 in FIGS. 3–5.

The pickup member 6 is formed as a ball centered generally on an axis A and formed with a throughgoing hole 10 at this axis A. On each side as seen best in FIG. 2 the member 5 has a flat 15 extending perpendicular to the axis A.

In addition the member 5 is formed with a radially open slot 8 having an enlarged end 9 of a diameter sufficiently great to accept the head 4 of the bolt 2, but otherwise the slot 8 is so narrow that it can only receive the shaft 3 of the bolt 2.

The shackle 7 is formed as best seen in FIG. 2 with an integral crosspiece 11 subdividing it into a lower pivot eye 12 extending through the hole 10 at the axis A and an upper lift eye 13 through which is engaged the lift member 23. The eye 12 is circular and has a diameter D which is slightly smaller than the radial extent of the arm 6, so that this arm 6 cannot pivot through the eye 12. A trip line 14 is connected to the free outer end of the arm 6 and extends through the eye 12.

In the use the trip line 14 is tensioned enough so that as shown in FIG. 3 the arm 6 lies parallel to the plane of the shackle 7. In this position the entire assembly is laid down on the body 1 so that the head 4 of the bolt 2 can pass radially in through the wide end 9 of the slot 8. Thereafter as shown in FIG. 4 some tension is applied to the element 23 to move the shackle 7 into the vertical position, and simultaneously the entire member 5 is allowed to flop over so that the arm 6 lies flatly on the upper surface of the block 1 in a position 180° offset to that of FIG. 3. In this position the head 4 is engaged all the way in the narrow end of the slot 8 and the arrangement can be lifted.

Should by accident tension be exerted on the trip line 14 when the body 1 is supported by the member 5 as shown in FIG. 5, the arm 6 will not be able to pivot through the eye 12, so that the head 4 of the bolt 2 will only lie in the still thin central region 4 of the slot 8. Thus the head 4 remains effectively captured. Only by positioning the shackle 7 plus the member 5 in the position of FIG. 3 can the bolt 2 be disengaged, and obviously such a position cannot be assumed while the cable 23 is tensioned with the load in the body 1. It is therefore almost impossible to drop the body 1.

Figure 6:
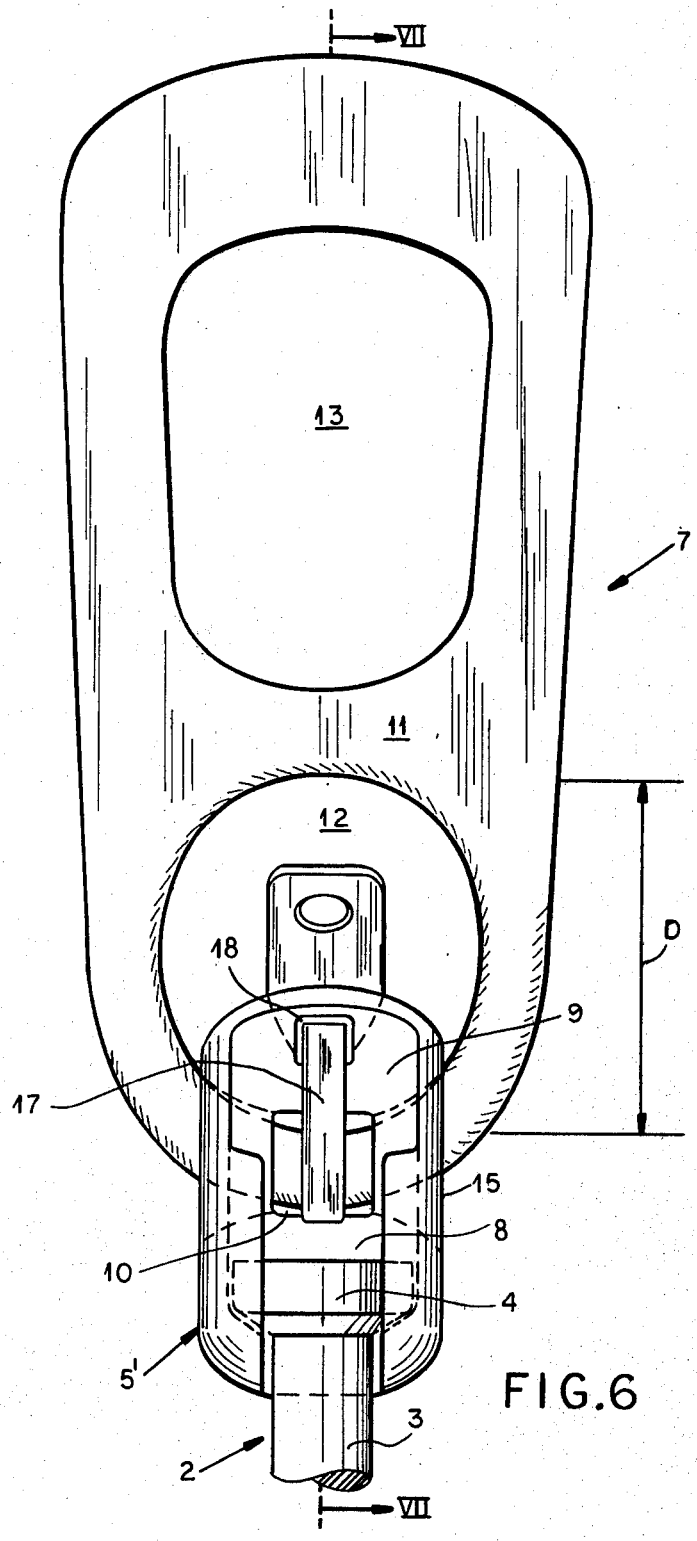
FIG. 6 is a view similar to FIG. 2 showing another pickup device according to this invention.
Figure 7:
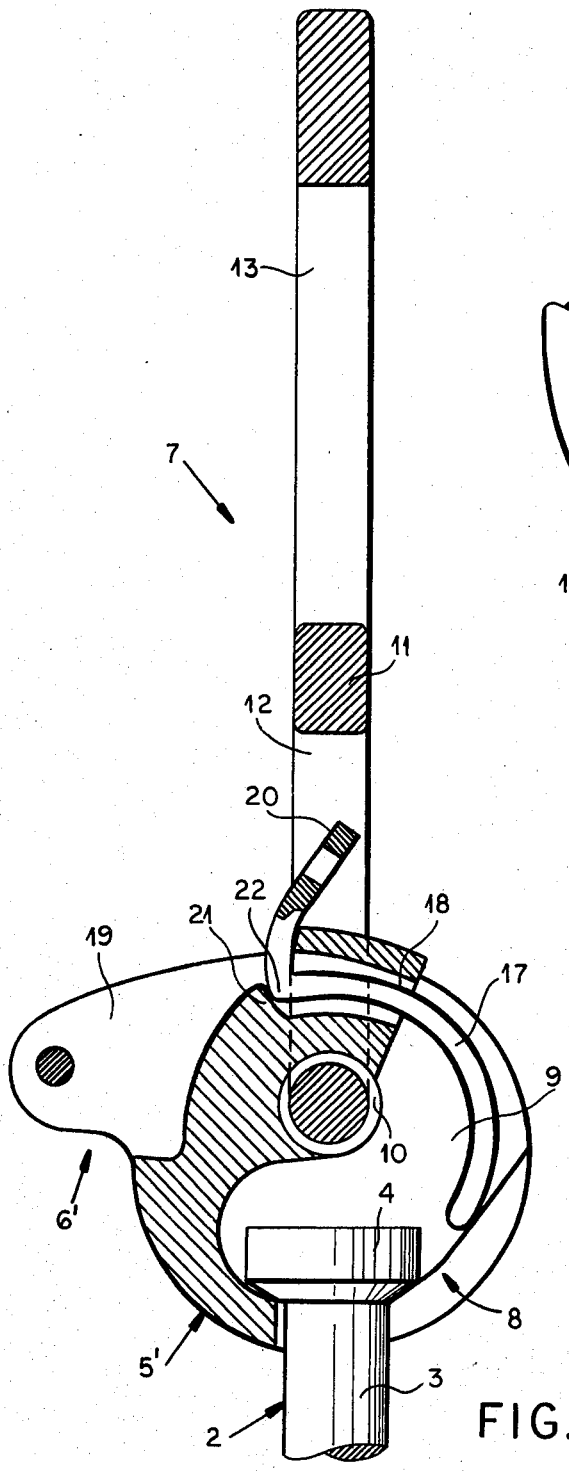
FIG. 7 is a section taken along line VII—VII of FIG. 6.

FIGS. 6 and 7 show another arrangement wherein an arm 6 is relatively short. Here an oval-section arcuate locking bolt 17 is displaceable in an arcuate guide passage 18 formed in the member 5′ and opening in line with the slot 8 adjacent the wide end 9 thereof. This guide passage 18 is formed with a shoulder 21 engageable with a corner 22 of the locking bolt 17. Only by shifting this locking bolt 17 radially outwardly to clear this shoulder 21 can the locking bolt 17 be slid through the guide passage 18 to a position unblocking the wide end 9 of the slot 8. The freeing position is assumed by motion of the outer part 20 of the locking bolt 17 between a pair of side parts 19 forming the actuation arm 6′ which is here substantially shorter than in FIGS. 1–5 so that it can pass through the eye 12.

Figure 11:
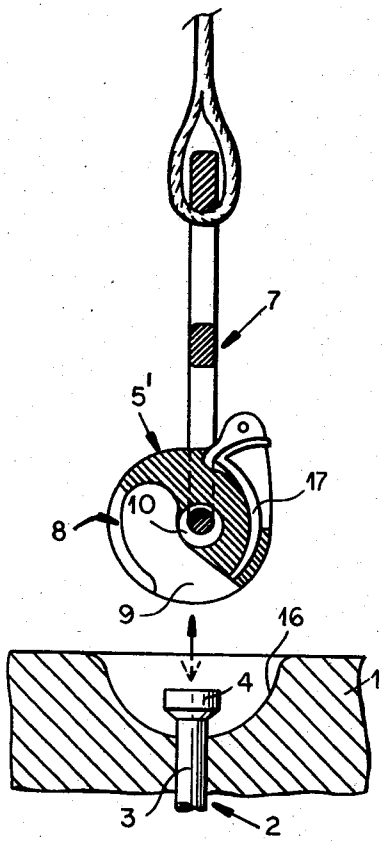
FIGS. 9–11 are vertical sections showing operation of the device of FIGS. 6 and 7.
Figure 10:
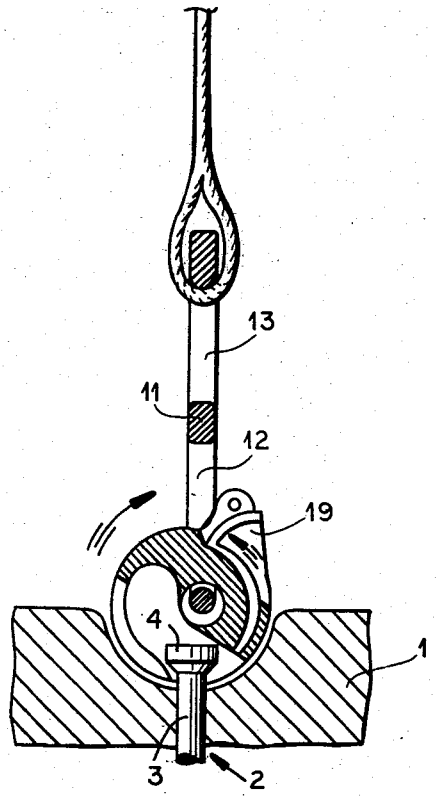
Figure 9:
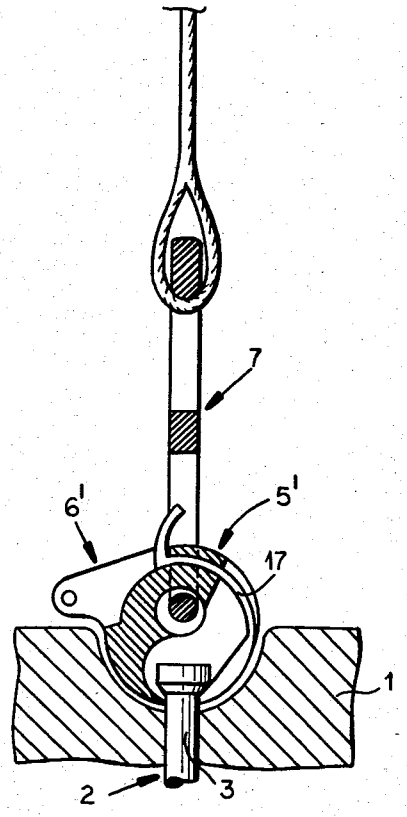

Thus as shown in FIGS. 9–11 the system of FIGS. 6 and 7 makes it virtually impossible, even by pivoting the member of 5′, to disengage the bolt 2 from the slot 8. Only by pulling the bolt 17 back, after lifting it up over the shoulder 21, can it be moved into the freeing positions of FIGS. 10 and 11. In addition it is noted that the center of gravity of the body 5′ is such that it will normally seek to move the bolt head 4 into the narrow end of the slot 8.

Figure 8:
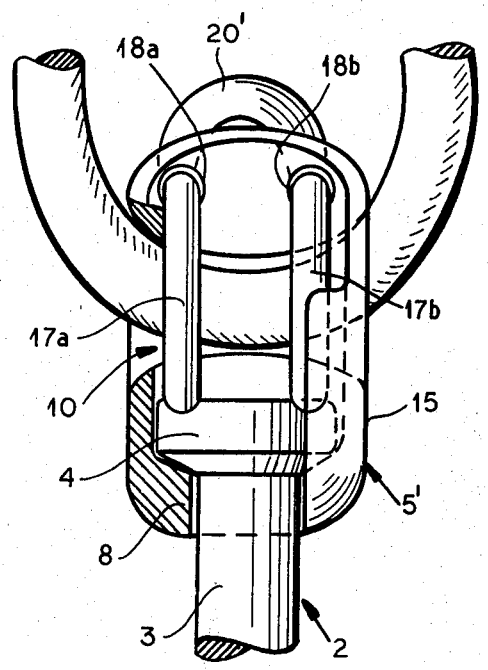
FIG. 8 is a large-scale view of a detail of another arrangement according to this invention.

Finally FIG. 8 shows an arrangement wherein a locking bolt is formed by a pair of wires 17*a* and 17*b* received in respective guide holes 18*a* and 18*b* and joined together by a bight 20° lying outside the member 5′. This arrangement functions identically to that of the arrangement of FIGS. 5 and 6, and the spacing between the wires or legs 17*a* and 17*b* can be sufficient to allow the shaft 3 of the bolt 2 to move between them.

We claim:

1. A pickup device for lifting a body from which projects a bolt having a relatively narrow shaft embedded in and projecting from said body and a relatively wide head on said shaft spaced from said body, said device comprising:

a shackle lying generally in a shackle plane and having a crosspiece defining a lift eye and a pivot eye;

a pickup member pivotal on said pivot eye on said shackle about a pickup axis and having a generally radially extending actuation arm having an outer end angularly engageable with said crosspiece, the radial distance between said outer end and said axis being greater than the diameter of said pivot eye, and an angularly elongated and outwardly open pickup slot lying generally in a plane perpendicular to said axis and having a relatively wide end permitting radial passage of said head into and out of said slot and an angularly opposite relatively narrow end internally sufficiently wide to accommodate said head but externally insufficiently wide to permit radial passage of said head out of said slot, said slot being internally sufficiently wide between said ends to permit said head to pass angularly along said slot between said ends with said shaft extending out of said slot, whereby said member can pivot about said axis with said bolt engaged in said slot, and means for pivoting said pickup member on said pivot eye between a pickup position with said arm lying against said crosspiece and said wide end of said slot opening generally perpendicularly to said axis and said shackle plane and a holding position with said actuation arm generally perpendicular to said shackle plane and said narrow end of said slot opening generally perpendicularly to the axis in line with said shackle plane away from the crosspiece.

2. The device defined in claim 1 wherein said means includes a trip line connected to said outer end.

3. The device defined in claim 1 wherein said arm lies generally in a plane including said axis and said wide end opens generally at a right angle to said plane.

4. The device defined in claim 1 wherein said pickup member is formed with a pair of generally parallal flats generally perpendicular to said axis and at said axis.

* * * * *